US005307417A

United States Patent [19]

Takamura et al.

[11] Patent Number: 5,307,417

[45] Date of Patent: Apr. 26, 1994

[54] SOUND SYSTEM WITH HOWLING-PREVENTION FUNCTION

[75] Inventors: Yoshinobu Takamura; Kazunaga Ida; Fumio Matsushita, all of Tokyo, Japan

[73] Assignee: Pioneer Electronic Corporation, Tokyo, Japan

[21] Appl. No.: 999,544

[22] Filed: Dec. 31, 1992

Related U.S. Application Data

[63] Continuation of Ser. No. 561,433, Aug. 1, 1990, abandoned.

[30] Foreign Application Priority Data

Jan. 16, 1990 [JP] Japan ..... 2-7998
Mar. 27, 1990 [JP] Japan ..... 2-78478

[51] Int. Cl.[5] ..... H04R 27/00
[52] U.S. Cl. ..... 381/83; 381/93
[58] Field of Search ..... 381/83, 93, 97

[56] References Cited

U.S. PATENT DOCUMENTS 3,681,531 8/1972 Burkhard et al. .
4,039,753 8/1977 Balogh et al. ..... 381/83
4,449,237 5/1984 Stepp et al. ..... 381/93

FOREIGN PATENT DOCUMENTS 0209894 1/1987 European Pat. Off. .
0130523 4/1978 German Democratic Rep. ... 381/83
2073994 10/1981 United Kingdom .

OTHER PUBLICATIONS

Beigel, "A Digital 'Phase Shifter' for Musical Applications, Using the Bell Labs (Alles-Fischer) Digital Filter Module", JAES, Sep. 1979, vol. 27, No. 9.
Chamberlin, "Musical Applications of Microprocessors", 1980, pp. 447-451.

*Primary Examiner*—Forester W. Isen
*Attorney, Agent, or Firm*—Sughrue, Mion, Zinn, Macpeak & Seas

[57] ABSTRACT

A sound system with a howling-prevention function comprises an all-pass filter having group delay characteristics, which vary with the elapse of time, provided on a line used for the transmission of an audio signal from a microphone. Owing to the provision of such a sound system, any deterioration in the sound quality with respect to high frequencies and a chorus phenomenon is not produced, thereby making it possible to prevent howling without causing inferior sound quality.

15 Claims, 9 Drawing Sheets

Fig. 7

| TURN TO BE READ | COEFFICIENT DATA GROUPS | TURN TO BE READ | COEFFICIENT DATA GROUPS | TURN TO BE READ | COEFFICIENT DATA GROUPS |
|---|---|---|---|---|---|
| 1 | $F_1$ | 11 | $F_1 + 2\Delta F$ | 21 | $F_1 + 4\Delta F$ |
| 2 | $F_2$ | 12 | $F_2 + 2\Delta F$ | 22 | $F_2 + 4\Delta F$ |
| 3 | $F_3$ | 13 | $F_3 + 2\Delta F$ | 23 | $F_3 + 4\Delta F$ |
| 4 | $F_4$ | 14 | $F_4 + 2\Delta F$ | 24 | $F_4 + 4\Delta F$ |
| 5 | $F_5$ | 15 | $F_5 + 2\Delta F$ | 25 | $F_5 + 4\Delta F$ |
| 6 | $F_1 + \Delta F$ | 16 | $F_1 + 3\Delta F$ | 26 | $F_1 + 5\Delta F$ |
| 7 | $F_2 + \Delta F$ | 17 | $F_2 + 3\Delta F$ | 27 | $F_2 + 5\Delta F$ |
| 8 | $F_3 + \Delta F$ | 18 | $F_3 + 3\Delta F$ | 28 | $F_3 + 5\Delta F$ |
| 9 | $F_4 + \Delta F$ | 19 | $F_4 + 3\Delta F$ | 29 | $F_4 + 5\Delta F$ |
| 10 | $F_5 + \Delta F$ | 20 | $F_5 + 3\Delta F$ | 30 | $F_5 + 5\Delta F$ |

Fig. 8

| TURN TO BE PROCESSED | CENTER FREQUENCIES AT FIRST BAND | CENTER FREQUENCIES AT SECOND BAND | CENTER FREQUENCIES AT THIRD BAND | CENTER FREQUENCIES AT FOURTH BAND | CENTER FREQUENCIES AT FIFTH BAND |
|---|---|---|---|---|---|
| 1 | $f_1$ | $f_2$ | $f_3$ | $f_4$ | $f_5$ |
| 2 | $f_1 + \Delta f$ | $f_2 + \Delta f$ | $f_3 + \Delta f$ | $f_4 + \Delta f$ | $f_5 + \Delta f$ |
| 3 | $f_1 + 2\Delta f$ | $f_2 + 2\Delta f$ | $f_3 + 2\Delta f$ | $f_4 + 2\Delta f$ | $f_5 + 2\Delta f$ |
| 4 | $f_1 + 3\Delta f$ | $f_2 + 3\Delta f$ | $f_3 + 3\Delta f$ | $f_4 + 3\Delta f$ | $f_5 + 3\Delta f$ |
| 5 | $f_1 + 4\Delta f$ | $f_2 + 4\Delta f$ | $f_3 + 4\Delta f$ | $f_4 + 4\Delta f$ | $f_5 + 4\Delta f$ |
| 6 | $f_1 + 5\Delta f$ | $f_2 + 5\Delta f$ | $f_3 + 5\Delta f$ | $f_4 + 5\Delta f$ | $f_5 + 5\Delta f$ |
| 7 | $f_1$ | $f_2$ | $f_3$ | $f_4$ | $f_5$ |
| 8 | $f_1 + \Delta f$ | $f_2 + \Delta f$ | $f_3 + \Delta f$ | $f_4 + \Delta f$ | $f_5 + \Delta f$ |
| ⋮ | ⋮ | ⋮ | ⋮ | ⋮ | ⋮ |

Fig.10

| TURN TO BE READ | COEFFICIENT DATA GROUPS | TURN TO BE READ | COEFFICIENT DATA GROUPS | TURN TO BE READ | COEFFICIENT DATA GROUPS |
|---|---|---|---|---|---|
| 1 | $F_1$ | 11 | $F_1 + \Delta F$ | 21 | $F_1 + \Delta F$ |
| 2 | $F_2$ | 12 | $F_2 + 2\Delta F$ | 22 | $F_2 + 2\Delta F$ |
| 3 | $F_3$ | 13 | $F_3 + 2\Delta F$ | 23 | $F_3 + 3\Delta F$ |
| 4 | $F_4$ | 14 | $F_4 + 2\Delta F$ | 24 | $F_4 + 4\Delta F$ |
| 5 | $F_5$ | 15 | $F_5 + 2\Delta F$ | 25 | $F_5 + 4\Delta F$ |
| 6 | $F_1 + \Delta F$ | 16 | $F_1 + \Delta F$ | 26 | $F_1 + \Delta F$ |
| 7 | $F_2 + \Delta F$ | 17 | $F_2 + 2\Delta F$ | 27 | $F_2 + 2\Delta F$ |
| 8 | $F_3 + \Delta F$ | 18 | $F_3 + 3\Delta F$ | 28 | $F_3 + 3\Delta F$ |
| 9 | $F_4 + \Delta F$ | 19 | $F_4 + 3\Delta F$ | 29 | $F_4 + 4\Delta F$ |
| 10 | $F_5 + \Delta F$ | 20 | $F_5 + 3\Delta F$ | 30 | $F_5 + 5\Delta F$ |

Fig.11

| TURN TO BE PROCESSED | CENTER FREQUENCIES AT FIRST BAND | CENTER FREQUENCIES AT SECOND BAND | CENTER FREQUENCIES AT THIRD BAND | CENTER FREQUENCIES AT FOURTH BAND | CENTER FREQUENCIES AT FIFTH BAND |
|---|---|---|---|---|---|
| 1 | $f_1$ | $f_2$ | $f_3$ | $f_4$ | $f_5$ |
| 2 | $f_1 + \Delta f$ | $f_2 + \Delta f$ | $f_3 + \Delta f$ | $f_4 + \Delta f$ | $f_5 + \Delta f$ |
| 3 | $f_1 + \Delta f$ | $f_2 + 2\Delta f$ | $f_3 + 2\Delta f$ | $f_4 + 2\Delta f$ | $f_5 + 2\Delta f$ |
| 4 | $f_1 + \Delta f$ | $f_2 + 2\Delta f$ | $f_3 + 3\Delta f$ | $f_4 + 3\Delta f$ | $f_5 + 3\Delta f$ |
| 5 | $f_1 + \Delta f$ | $f_2 + 2\Delta f$ | $f_3 + 3\Delta f$ | $f_4 + 4\Delta f$ | $f_5 + 4\Delta f$ |
| 6 | $f_1 + \Delta f$ | $f_2 + 2\Delta f$ | $f_3 + 3\Delta f$ | $f_4 + 4\Delta f$ | $f_5 + 5\Delta f$ |
| 7 | $f_1$ | $f_2$ | $f_3$ | $f_4$ | $f_5$ |
| 8 | $f_1 + \Delta f$ | $f_2 + \Delta f$ | $f_3 + \Delta f$ | $f_4 + \Delta f$ | $f_5 + \Delta f$ |
| ⋮ | ⋮ | ⋮ | ⋮ | ⋮ | ⋮ |

SOUND SYSTEM WITH HOWLING-PREVENTION FUNCTION

This is a Continuation of application Ser. No. 07/561,433 filed Aug. 1, 1990, now abandoned.

BACKGROUND OF THE INVENTION

1. Field of the Invention

The present invention relates to a sound system with a howling-prevention function.

2. Description of the Related Art

As shown in FIG. 1, a sound system such as a public address system, is designed to receive voice or the like at a microphone 1 for thereby converting the same into a microphone signal, and thereafter to amplify the microphone signal as an output audio signal of the microphone 1 with a microphone amplifier 2 and a power amplifier 3 thereby to produce sound from a speaker 4. Such a sound system often develops howling when one attempts to turn up the volume or to bring the microphone 1 close to the speaker. The howling is produced by forming repeatedly carried out positive feedback loop in which sound corresponding to the microphone signal is produced from the speaker 4 and the produced sound is received at the microphone 1 again thereby to be reproduced from the speaker 4.

In order to avoid such howling, there is provided a sound system including the microphone amplifier 2 having frequency characteristics in which high frequency components have been cut off. In addition, as shown in FIG. 2, there is also provided a sound system of such a type that an A/D converter 5, a delay circuit 6 and a D/A converter 7 are disposed between the microphone amplifier 2 and the power amplifier 3 thereby causing a delay time interval introduced by the delay circuit 6 to vary with the elapse of time in response to an output signal from an oscillator 8, thereby to subject the same to digital processing.

However, the former is accompanied by the problem that there is no effect on the howling caused by signal components other than the high frequency components as well as deterioration in the sound quality because high frequency components of the microphone signal are omitted or disregarded. In addition, the latter is also accompanied by the problem that since the microphone signals within all bands are delayed, a chorus phenomenon appears in the sound issued at the speaker, thereby causing inferior sound quality.

SUMMARY OF THE INVENTION

It is an object of the present invention to provide a sound system which is capable of preventing any howling without causing inferior sound quality.

The present invention provides a sound system with a howling-prevention function, for inputting an audio signal generated from a microphone thereto, which comprises an all-pass filter having group delay characteristics which vary with the elapse of time, provided on a line used for the transmission of the audio signal.

The present invention also provides a sound system with a howling-prevention function, for inputting an audio signal issued from a microphone thereto, which comprises an all-pass filer having group delay characteristics which vary with the elapse of time, provided on a line used for the transmission of the audio signal, whereby time-dependent variations of the group delay characterisitcs of the all-pass filter are made faster as frequencies become high.

The above and other objects, features and advantages of the present invention will become apparent from the following description and the appended claims, taken in conjunction with the accompanying drawings in which preferred embodiments of the present invention are shown by way of illustrative example.

BRIEF DESCRIPTION OF THE DRAWINGS

FIG. 7 is a data format for describing the manner in which coefficient data groups are stored in a RAM provided within the DSP;

FIG. 8 is a diagram for explaining variations in center frequencies within respective bands employed in the first embodiment of the present invention;

FIG. 10 is a data format for illustrating the manner in which coefficient data groups employed in the second embodiment of the present invention are stored;

FIG. 11 is a diagram for describing variations of center frequencies within respective bands employed in the second embodiment of the present invention.

DETAILED DESCRIPTION OF THE PREFERRED EMBODIMENTS

Preferred embodiments of the present invention will hereinafter be described in detail with reference to the accompanying drawings.

Figure 1:
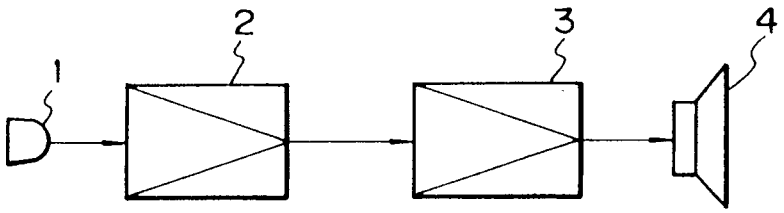
FIGS. 1 and 2 are block diagrams of sound system without and with howling-prevention functions, respectively.
Figure 2:
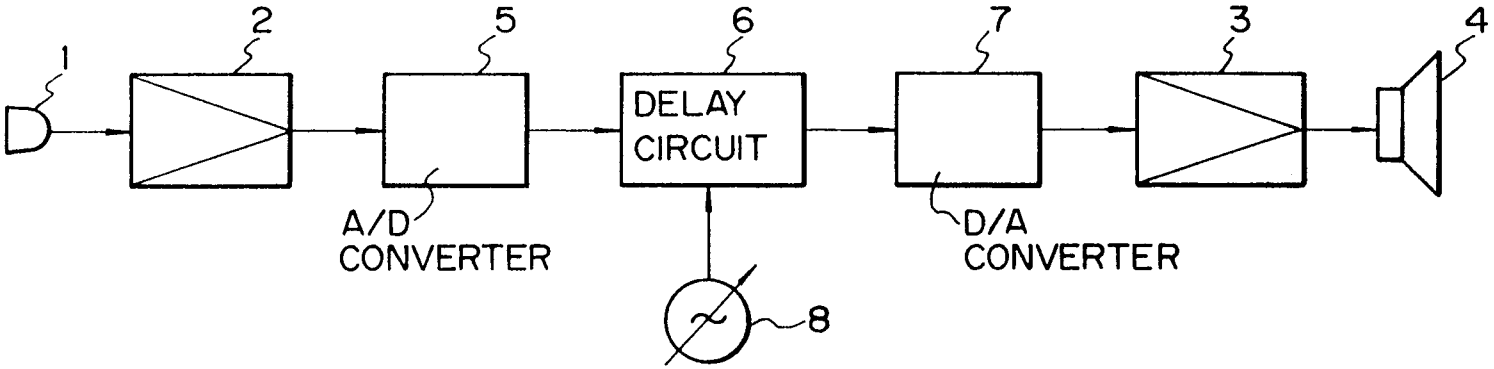
Figure 3:
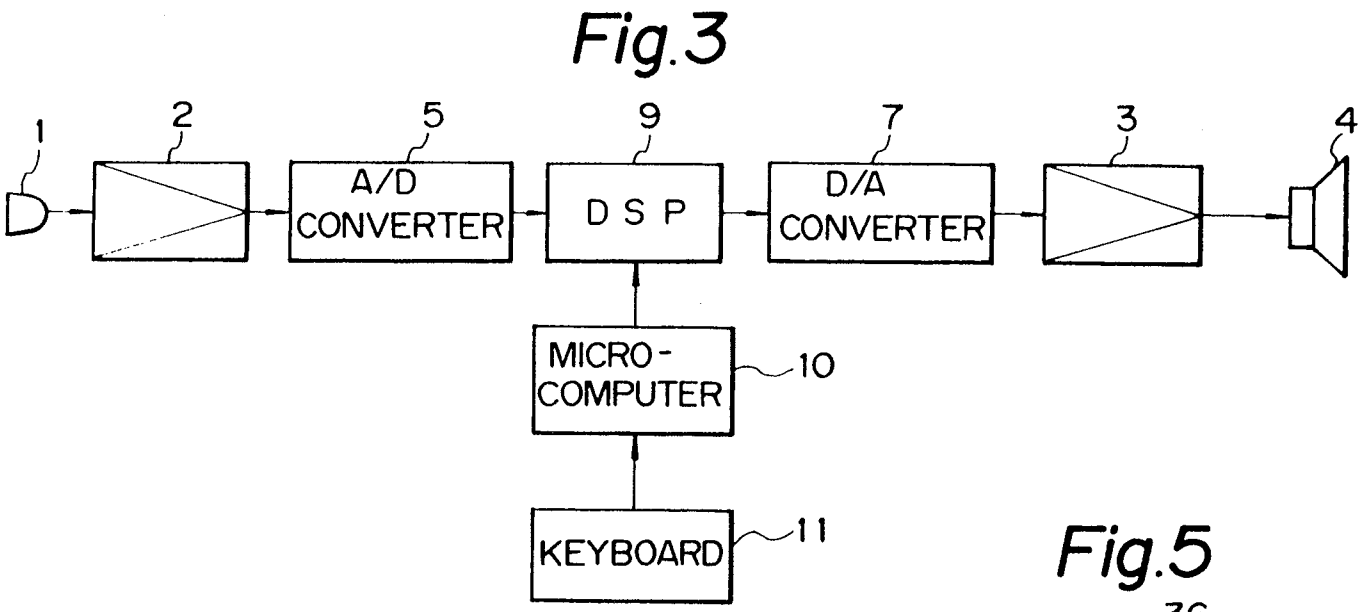
FIG. 3 is a block diagram showing a sound system according to a first embodiment of the present invention.

Referring first to FIG. 3, an output signal from a microphone 1 is supplied to a microphone amplifier 3 whose output is connected to an A/D converter 5. The A/D converter 5 has an output connected to a DSP (which is an abbreviation of a digital signal processor) 9. The DSP 9 is constructed as will be described later and is to be controlled by a microcomputer 10. To an output of DSP 9 is connected a D/A converter 7 which converts a digital signal supplied thereto into an analog audio signal. The D/A converter 7 has an output connected to a speaker 4 via a power amplifier 3 in the same manner as in the conventional example.

Figure 4:
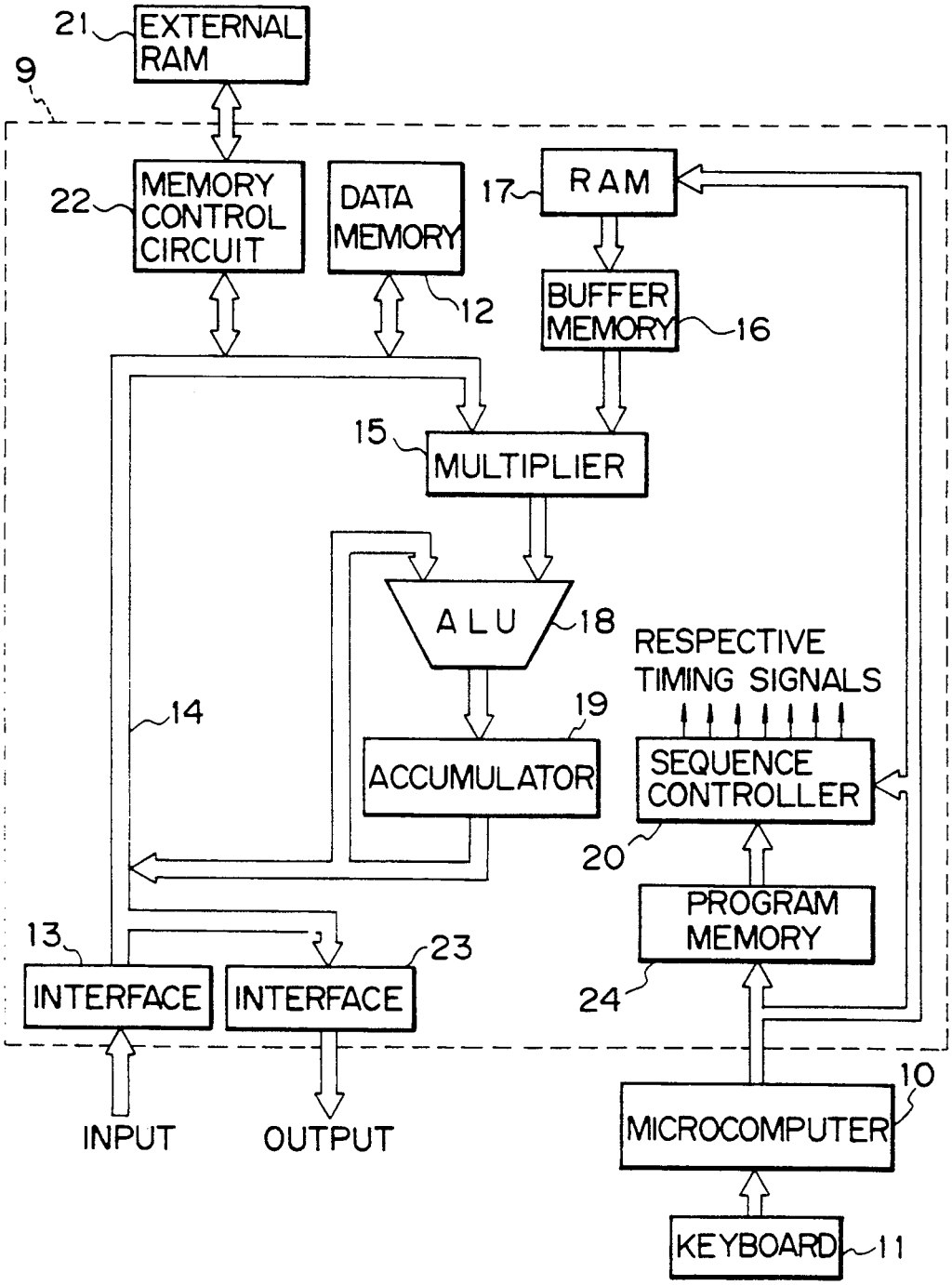
FIG. 4 is a block diagram showing a structure of a DSP employed in the sound system of FIG. 3.

FIG. 4 schematically shows the construction of the DSP 9. More specifically, a digital signal from the A/D converter 5 is supplied to an input interface 13 in the DSP 9. A data bus 14 is connected to the input interface 13 and is also connected to a data memory 12 for temporarily storing a signal data group therein and to one input of a multiplier 15. A buffer memory 16 for holding coefficient data therein is connected to the other input of the multiplier 15. A RAM 17 is coupled to the buffer memory 16 and stores a plurality of coefficient data therein. One coefficient data is read sequentially out of the coefficient data group, which has been stored in the RAM 17, in accordance with a timing signal from a sequence controller 20, which will be described subsequently, and then supplied to the buffer memory 16, thereby to be held therein. The coefficient data which has been retained in the buffer memory 16 is then supplied to the multiplier 15. An ALU (Arithmetic Logic Unit) 18 is provided to accumulate therein outputs as a result of calculations by the multiplier 15. In addition, one of inputs of the ALU 18 receives the outputs of the multiplier 15 and the other thereof is connected to the data bus 14. An accumulator 19 is connected to a calculation output of the ALU 18, and an output of the accumulator 19 is connected to the data bus 14. A memory control circuit 22 for controlling the writing of data into an external memory 21 and the reading of the same therefrom is connected to the data bus 14 in order to produce delay data.

In addition, an output interface 23 is connected to the data bus 14 and outputs a digital audio signal, which is in turn supplied to the D/A converter 7 as an output signal of the DSP 9.

Operations of the interfaces 13, 23, the multiplier 15, the RAM 17, the ALU 18, the accumulator 19 and the memory control circuit 22 re controlled by the sequence controller 20. The sequence controller 20 operates in accordance with processing programs written into a program memory 24 and also operates according to commands from the microcomputer 10. A keyboard 11 is connected to the microcomputer 10 in order to give various commands from its key operation. The microcomputer 10 serves to control writing of coefficient data into the RAM 17 in accordance with keystrokes of the keyboard 11.

In the above-described construction, a microphone signal supplied to the A/D converter 5 is converted into data representative of a digital audio signal every given sampling cycle and then supplied to the data memory 12 through the interface 13, thereby to be stored therein. On the other hand, coefficient data read out of the RAM 17 is supplied to the buffer memory 16 thereby to be retained therein. The sequence controller 20 provides various timings such as a timing for reading data from the interface 13, a timing for selectively transferring data from the data memory 12 to the multiplier 15, a timing for outputting respective coefficient data from the RAM 17, a timing for performing a multiplying operation of the multiplier 15, a timing for performing an adding operation of the ALU 18, an output timing of the accumulator 19 and a timing for outputting data representative of arithmetic-operated results from the interface 23. If each of these timings is adequately provided, for example, coefficient data $\alpha_1$ is supplied to the multiplier 15 from the buffer memory 16, whereas data $d_1$ is supplied to the multiplier 15 from the data memory 12. Then, $\alpha_1.d_1$ is first arithmetically operated in the multiplier 15. When the operation of $\alpha_1.d_1$ is carried out, $0+\alpha_1.d_1$ is arithmetically operated in the ALU 18, so that the result obtained by its calculation is held in the accumulator 19. Next, when coefficient data $\alpha_2$ is issued from the buffer memory 16 and data $d_2$ is issued from the data memory 12, $\alpha_2.d_2$ is arithmetically operated in the multiplier 15 and $\alpha_1.d_1$ is issued from the accumulator 19. Then, $\alpha_1.d_1+\alpha_2.d_2$ are arithmetically operated in the ALU 18, so that the operated result is stored in the accumulator 19. By repeatedly preforming the above process, $$\sum_{i=1}^{n} \alpha_i \cdot d_i$$

is calculated.

Where it is desired to produce delay data for reflected sound or the like, data is read out from the data memory 12 and supplied to the memory control circuit 22 via the data bus 14. Then, the memory control circuit 22 serves to successively write supplied data into the external memory 21. After having been written therein, the memory control circuit 22 reads the data from the external memory 21 as delay data when a predetermined delay time interval corresponding to the delay data have elapsed. The delay data is supplied to the data memory 12 via the data bus 14 to be stored therein, and is used for the aforementioned arithmetic operation.

Figure 5:
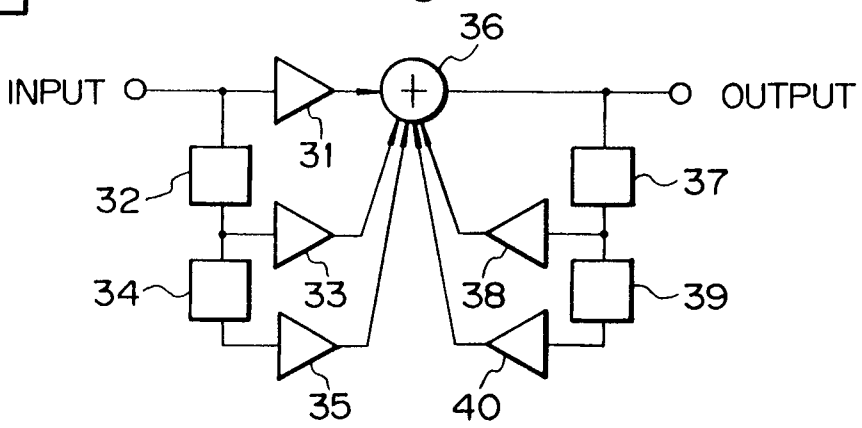
FIG. 5 is a circuit diagram showing an equivalent circuit which serves to carry out the same operation as that of the DSP.

If the operation of the DSP 9 employed in the sound system of the present invention is represented by the equivalent circuit, it is equivalent to one constructed as a secondary IIR type filter as shown in FIG. 5. In this filter, a coefficient multiplier 31 and a delay device 32 are connected to an input terminal supplied with an audio data signal. A coefficient multiplier 33 and a delay device 34 are also connected to an output of the delay device 32. Further, a coefficient multiplier 35 is connected to an output of the delay device 34. Each of outputs of the coefficient multipliers 31, 33, 35 is coupled to an adder 36. A delay device 37 is connected to an output of the adder 36. A coefficient multiplier 38 and a delay device 39 are also connected to an output of the delay device 37. In addition, a coefficient multiplier 40 is connected to an output of the delay device 39. Each of outputs of the coefficient multipliers 38, 40 is also coupled to the adder 36.

The delay time of each of the delay devices 32, 34, 39 is equivalent to one sampling cycle. Thus, data supplied to the multiplier 33 corresponds to previous data delayed by one sampling cycle as compared with data supplied to the multiplier 31, whereas data supplied to the multiplier 35 corresponds to previous data delayed by two sampling cycles as compared with the data supplied to the multiplier 31. The multipliers 38, 40 are also similar to the multipliers 33, 35.

Figure 6:
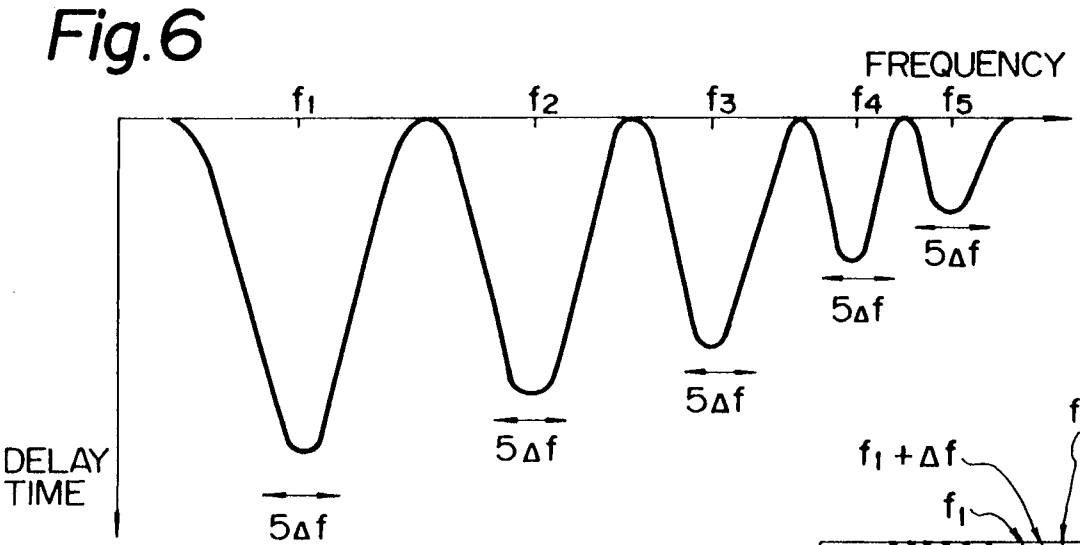
FIG. 6 is a graph for describing a group delay characteristic employed in the first embodiment of the present invention.

Coefficients of the multipliers 31, 33, 35, 38 and 40 are $a_0$, $a_1$, $a_2$, $b_1b_2$, respectively. When these coefficients are respectively set as $a_0=A$, $a_1=B$, $a_2=1$, $b_1=-B$, $b_2=-A$, the secondary IIR type filter is operated as an all-pass filter. More specifically, the center frequency and the delay time vary with the settings of the values of A and B. Therefore, if A and B are set such that the desired delay time can be obtained for every center frequency in each of the bands, the all-pass filter should have group delay characteristics defining the center frequencies of the respective bands as $f_1$ through f5, as shown in FIG. 6.

Where it is desired to form one band of each of the all-pass filter with such group delay characteristics as referred to above by digital processing of the DSP 9, the DSP 9 is actuated in the following manner.

First, input audio signal data $d_n$ is read out from address n of the data memory 12 in the first step, and the coefficient data $a_2$ is read from the RAM 17 and transferred to the buffer memory 16, followed by multiplication of the same with the multiplier 15. The ALU 18 adds zero to the result thus multiplied, $a_2.d_n$ in the third step advanced by two steps from the first step, and the added result is stored in the accumulator 19.

In the second step, signal data $d_{n-1}$ is read out from address n-1 of the data memory 12 in the second step. Then, the multiplier 15 multiplies the read signal data $d_{n-1}$ by coefficient data $a_1$ newly read from the RAM 17. In addition, the ALU 18 adds the value (the added result in the third step) stored in the accumulator 19 to the multiplied result $a_1.d_{n-1}$ in the fourth step, and the added result is retained in the accumulator 19. Next, input signal data IN is transferred from the interface 13 to address n-2 of the data memory 12 and the multiplier 15, which in turn multiplies the data IN by coefficient data $a_0$. Then, the ALU 18 adds the value (the added result in the fourth step) stored in the accumulator 19 to the multiplied result $a_0$.IN in the fifth step, followed by storage of the added result in the accumulator 19.

In the fourth step, signal data $d_{n+2}$ is read from address n+2 of the data memory 12. Then, the multiplier 15 multiplies the read signal data $d_{n+2}$ by coefficient data $b_2$ newly read from the RAM 17. Next, the ALU 18 adds the value (the added result in the fifth step) stored in the accumulator 19 to the multiplied result $b_2.d_{n+2}$ in the sixth step, and the added result is retained in the accumulator 19. In addition, in the fifth step, signal data $d_{n+1}$ is read from address n+1 of the data memory 12. Then, the multiplier 15 multiplies the read signal data $d_{n+1}$ by the coefficient data $b_1$. Next, the ALU 18 adds the value (the added result in the sixth step) stored in the accumulator 19 to the multiplied result $b_1.d_{n+1}$ in the seventh step, and the result thus added is stored as output data in the accumulator 19.

The respective coefficient data $a_0$, $a_1$, $a_2$, $b_1$ and $b_2$ are those read from an internal memory (not shown) of the microcomputer 10 and transferred to a given coefficient data area of the RAM 17. In this coefficient data area, a plurality of data groups with A and B, whose values are different from each other are stored from address 1 in order of $a_1$, $a_1$, $a_0$, $b_2$ and $b_1$, defining the coefficient data $a_0$, $a_1$, $a_1$, $b_1$ and $b_2$ as one data group. More specifically, as shown in FIG. 7, coefficient data groups $F_1$, $F_2$, $F_3$, $F_4$, $F_5$, $F_1+\Delta F$, $F_2+\Delta F$, . . . , $F_4+5\Delta F$, $F_5+5\Delta F$ each of which has the coefficient data $a_2$, $a_1$, $a_0$, $b_2$, $b_1$ are stored in reading order. The data groups $F_1$, $F_2$, $F_3$, $F_4$ and $F_5$ are those for obtaining the center frequencies $f_1$, $f_2$, $f_3$, $f_4$ and $f_5$ in each band, having the group delay characteristics, each of which is defined as a reference frequency. Incidentally, the relation between $f_1$, $f_2$, $f_3$, $f_4$ and $f_5$ is established as $f_1<f_2<f_3<f_4<f_5$. The data group $F_1+\Delta F$ is equivalent to the data group in which a frequency obtained by adding a frequency width $\Delta f$ of unitary change to the center frequency $f_1$ is defined as the center frequency having the group delay characteristic. The data group $F_1+2\Delta F$ is equivalent to the data group in which a frequency obtained by adding a frequency change width $2\times\Delta f$ to the center frequency $f_1$ is defined as the center frequency having the group delay characteristic. Similarly, the data groups $F_1+3\Delta F$, $F_1+4\Delta F$, $F_1+5\Delta F$ are equivalent to those in which respective frequencies obtained by adding frequency change widths $3\times\Delta f$, $4\times\Delta f$ and $5\times\Delta f$ to the frequency $f_1$ are defined as the center frequencies in the respective bands, having the group delay characteristics. Other data groups $F_2$, $F_3$, $F_4$ and $F_5$ are also similar to the case where the data group $F_1$ is represented as described above. Upon reading of coefficient data from the memory 17, the coefficient data are read in order from the address 1, i.e., in order of the coefficient data $a_1$, $a_1$, $a_0$, $b_2$, $b_1$ belonging to the data group $F_1$, the subsequent coefficient data $a_1$, $a_1$, $a_0$, $b_2$, $b_1$ belonging to the data group $F_2$, . . . , based on each of the timings of the sequence controller 20. When the coefficient data $a_1$, $a_1$, $a_0$, $b_2$, $b_1$ belonging to the data group $F_5+5\Delta F$ are read from the memory 17, the coefficient data belonging to the data group $F_1$ of the address 1 are read again.

Each of the read coefficient data groups $F_1$ through $F_5$ is multiplied by a sampling signal data group of the first timing, whereas each of the coefficient data groups $F_1+\Delta F$ through $F_5+\Delta F$ is multiplied by a sampling signal data group of the second timing subsequent to the first timing. Similarly, each of the coefficient data groups $F_1+2\Delta F$ through $F_5+2\Delta F$, each of the coefficient data groups $F_1+3\Delta F$ through $F_5+3\Delta F$, each of the coefficient data groups $F_1+4\Delta F$ through $F_5+4\Delta F$, and each of the coefficient data groups $F_1+5\Delta F$ through $F_5+5\Delta F$ are also carried out below in the same manner as described above. This process is repeatedly performed.

Figure 9:
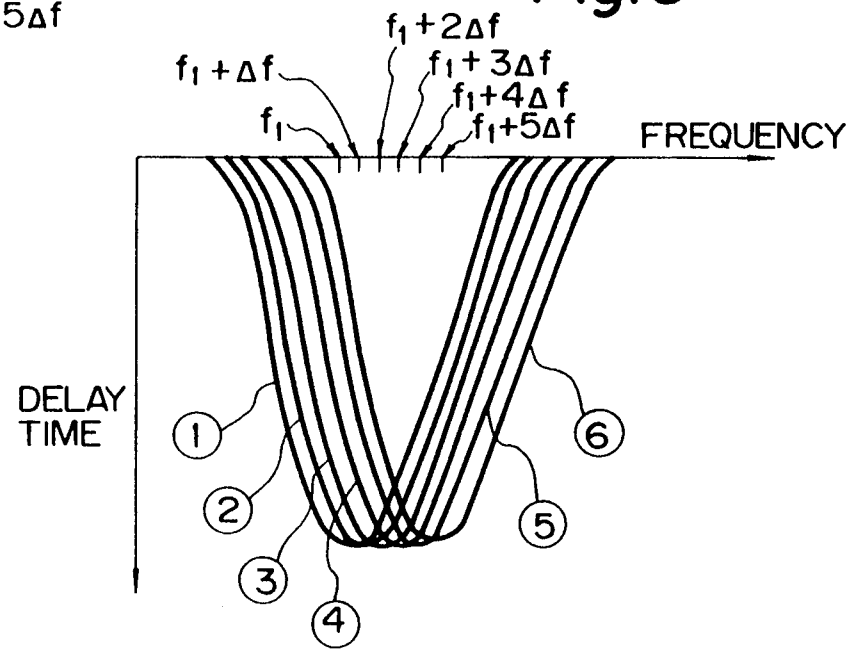
FIG. 9 is a graph for describing variations in delay characteristics of a first band, out of group delay characteristics employed in a second embodiment of the present invention.

Accordingly, the center frequencies in the respective bands, which have the group delay characteristics, are represented as shown in FIG. 8. In other words, the center frequencies $f_1-f_5$ are associated with the coefficient data groups $F_1-F_5$ to be read, the center frequencies $f_1+\Delta f$ through $f_5+\Delta f$ are associated with the coefficient data groups $F_1+\Delta F$ through $F_5+\Delta F$, the center frequencies $f_1+2\Delta f$ through $f_5+2\Delta f$ are associated with the coefficient data groups $F_1+2\Delta F$ through $F_5+2\Delta F$, the center frequencies $f_1+3\Delta f$ through $f_5+3\Delta f$ are associated with the coefficient data groups $F_1+3\Delta F$ through $F_5+3\Delta F$, the center frequencies $f_1+4\Delta f$ through $f_5+4\Delta f$ are associated with the coefficient data groups $F_1+4\Delta F$ through $F_5+4\Delta F$, and the center frequencies $f_1+5\Delta f$ through $f_5+5\Delta f$ are associated with the coefficient data groups $F_1+5\Delta F$ through $F_5+5\Delta F$. Since this process is repeatedly carried out, the center frequency in each band having the group delay characteristic varies with the elapse of time. For example, the respective delay characteristics each defining the center frequency $f_1$ as the reference frequency vary in the form of a characteristic ① at the center frequency $f_1$, a characteristic ② at the center frequency $f_1+\Delta f$, a characteristic ③ at the center frequency $f_1+2\Delta f$, a characteristic ④ at the center frequency $f_1+3\Delta f$, a characteristic ⑤ at the center frequency $f_1+4\Delta f$, and a characteristic ⑥ at the center frequency $f_1+5\Delta f$, respectively, as shown in FIG. 9. Accordingly, the group delay characteristic can be obtained, as shown in FIG. 6, which varies with the elapse of time in a width of $5\Delta f$ for each band.

A description will now be made of a second embodiment of the present invention. This embodiment is also provided with the construction shown by each of FIGS. 3 and 4 representing the first embodiment of the present invention.

The second embodiment is different from the first embodiment in the following points. In other words, as shown in FIG. 10, written in the coefficient data area of the RAM 17 in order of addresses to be read out therefrom are coefficient data groups $F_1$, $F_2$, $F_3$, $F_4$, $F_5$, $F_1+\Delta F$ through $F_5+\Delta F$, $F_1+\Delta F$, $F_2+2\Delta F$, $F_3+2\Delta F$ through $F_5+2\Delta F$, $F_1+\Delta F$, $F_2+2\Delta F$, $F_3+3\Delta F$, $F_4+3\Delta F$, $F_5+3\Delta F$, $F_1+\Delta F$, $F_2+2\Delta F$, $F_3+3\Delta F$, $F_4+4\Delta f$, $F_5+4\Delta F$, $F_1+\Delta F$, $F_2+2\Delta F$, $F_3+3\Delta F$, $F_4+4\Delta F$, $F_5+5\Delta F$. Each of the coefficient data groups has the coefficient data $a_1$, $a_1$, $a_0$, $b_2$ and $b_1$ in order of the addresses to be read. Upon reading of the coefficient data from the corresponding addresses, they are read out in that order referred to above.

Each of the read coefficient data groups $F_1$ through $F_5$ is multiplied by the sampling signal data group of the first timing, whereas each of the coefficient data groups $F_1+\Delta F$ through $F_5+\Delta F$ is multiplied by the sampling signal data group with the second timing subsequent to the first timing. Similarly, each of the coefficient data groups $F_1+\Delta F$, $F_2+2\Delta F$, $F_3+2\Delta F$ through $F_5+2\Delta F$ is multiplied by a sampling signal data group with the third timing, each of the coefficient data groups $F_1+\Delta F$, $F_2+2\Delta F$, $F_3+3\Delta F$, $F_4+3\Delta F$, $F_5+3\Delta F$ is multiplied by a sampling signal data group with the fourth timing, and each of the coefficient data groups $F_1+\Delta F$, $F_2+2\Delta F$, $F_3+3\Delta F$, $F_4+4\Delta F$, $F_5+5\Delta F$ is multiplied by a sampling signal data group with the fifth timing. When this process is brought to completion, each of the coefficient data groups $F_1$ through $F_5$ is multiplied by a sampling signal data group with the sixth timing again. This process is repeatedly carried out.

Figure 12:
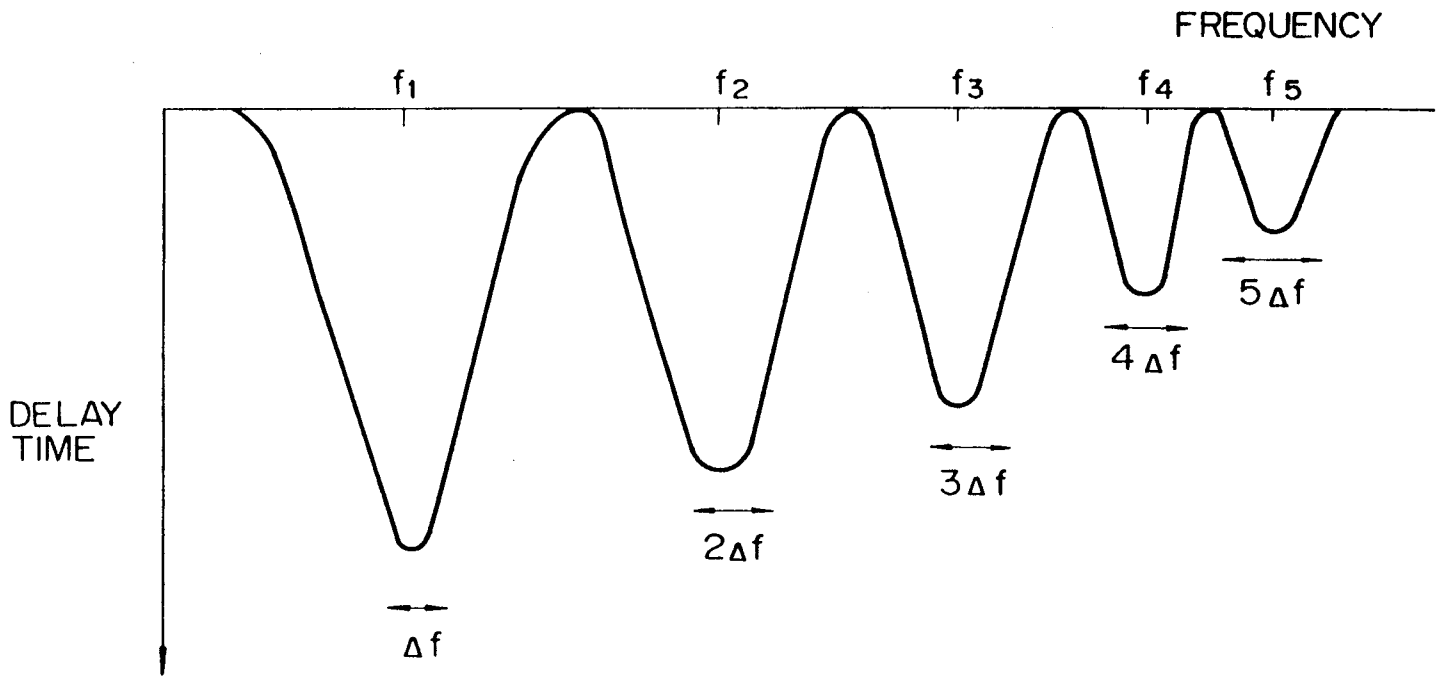
FIG. 12 is a graph for explaining a group delay characteristic employed in the second embodiment of the present invention.

Accordingly, as shown in FIG. 11, the center frequencies in the respective bands, which have the group delay characteristics, are determined in accordance with the read coefficient data groups in order of firstly; $f_1$ through $f_5$, secondly; $f_1+\Delta f$ through $f_5+\Delta f$, thirdly; $f_1+\Delta f$, $f_2+2\Delta f$, $f_3+2\Delta f$, $f_4+2\Delta f$ and $f_5+2\Delta f$, fourthly; $f_1+\Delta f$, $f_2+2\Delta f$, $f_3+3\Delta f$, $f_4+3\Delta f$ and $f_5+3\Delta f$, fifthly; $f_1+\Delta f$, $f_2+2\Delta f$, $f_3+3\Delta f$, $f_4+4\Delta f$ and $f_5+4\Delta f$, and sixthly; $f_1+\Delta f$, $f_2+2\Delta f$, $f_3+3\Delta f$, $f_4+4\Delta f$ and $f_5+5\Delta f$. Since this process is repeatedly performed, the center frequency in each band having the group delay characteristic varies with the elapse of time. In addition, the widths of changes in center frequencies are different from each other for each band and each of the change widths with respect to the center frequencies becomes large as the frequencies reach higher bands. More specifically, as shown in FIG. 12, the first band has a change width $\Delta f$ in a case where the frequency $f_1$ is defined as the reference frequency, the second band has a change width $2\Delta f$ in a case where the frequency $f_2$ is taken as the reference frequency, the third band has a change width $3\Delta f$ in the case of defining the frequency $f_3$ as the reference frequency, the fourth and has a change width $4\Delta f$ in the case of definition of the frequency $f_4$ as the reference frequency, and the fifth band has a change width $5\Delta f$ in the case of definition of the frequency $f_5$ as the reference frequency. Thus, the group delay characteristics having a rapid change with time can be obtained as the frequencies become higher.

Incidentally, it should be understood that the secondary IIR type filter shown in FIG. 5 may be provided for each band in the form of a circuit to be connected in series, thereby controlling multiplication coefficients thereof.

Each of the illustrated embodiments have used the secondary IIR type filter forming the all-pass filter. However, this invention is not necessarily limited to these embodiments employing the secondary IIR type filter.

In addition, the unitary change width $\Delta f$ has been set as constant in the aforementioned embodiments. However, the change width a f may be changed for each band or at a predetermined band and bands other than the predetermined band.

As has been described above, the sound system equipped with the howling-prevention function is provided, on a line used for the transmission of an audio signal from a microphone, with the all-pass filter having the group delay characteristic which varies with the elapse of time. Therefore, a phase difference between a radiated sound from a speaker and a sound obtained by inputting the radiated sound to a microphone can be changed with the elapse of time. In other words, any howling can be prevented because a positive feedback loop varies with the elapse of time. The all-pass filter has a amplitude characteristic which is constant with respect to frequency, and the group delay characteristic of the all-pass filter is a characteristic concerning the frequency. In addition, the group delay characteristic includes a delay characteristic which changes for each band. Accordingly, any deterioration in the sound quality with respect to high frequencies and a chorus phenomenon are not developed, thereby making it possible to prevent any howling without causing any degradation in the sound quality.

Since the sound system provided with the howling-prevention function has also, on the line for the transmission of the audio signal from the microphone, the all-pass filter having the group delay characteristic which varies with elapse of time, and its variation with the elapse of time is made faster as the frequencies become gradually higher, a relative modulation frequency (each width of change in the center frequency/reference frequency) can be rendered high with high bands. Accordingly, variation in the positive feedback loop with respect to the high frequency is made faster and hence the howling-prevention effect can be rendered satisfactory.

Having now fully described the invention, it will be apparent to those skilled in the art that many changes and modifications can be made without departing from the spirit or scope of the invention as set forth herein.

What is claimed is:

1. A sound system with a howling-prevention function, for inputting an audio signal issued from a microphone thereto, said system comprising:

an all-pass filter which separates the input audio signal into multiple frequency bands, each of which has a center frequency and a group delay characteristic, said all-pass filter being provided on a line used for the transmission of said audio signal, said all-pass filter periodically varying said center frequency of each of said frequency bands independently of one another by a predetermined frequency width by periodically varying each of said group delay characteristics based on an elapsed time.

2. A sound system according to claim 1, wherein said all-pass filter comprises a secondary IIR type filter.

3. A sound system according to claim 2, wherein said secondary IIR type filter is constructed in the form of arithmetically-operation processing executed by a digital signal processor.

4. The sound system of claim 1, wherein said all-phase filter sets a time delay, corresponding to a first band of said multiple frequency bands, to be longer than a time delay, corresponding to a last band of said multiple frequency bands.

5. The sound system of claim 1, wherein said predetermined frequency width represents a single unitary value for every center frequency variation.

6. The sound system of claim 1, wherein said all-pass filter cyclically increments each of said center frequencies by said predetermined frequency width for a predetermined number of cycles.

7. A sound system with a howling-prevention device responsive to control and data signals provided by a microcomputer for processing an audio signal produced by a microphone, said system comprising:

an all-pass recursive filter which separates the audio signal into at least first and second frequency bands, each of which has a center frequency determined independently of another and a group delay characteristic which varies over a predetermined time period wherein said all-pass recursive filter is serially coupled to a line used for transmission of said audio signal, said all-pass recursive filter independently setting a time delay, corresponding to said first frequency band, to be longer than a time delay, corresponding to said second frequency band.

8. The sound system of claim 7, wherein said all-phase recursive filter comprises a second order IIR type filter.

9. The sound system of claim 8, wherein said all-phase recursive filter comprises a digital signal processor and wherein said second order IIR type filter is provided by arithmetic processing executed by said digital signal processor.

10. The sound system of claim 7, wherein said all-phase filter periodically varies a center frequency of each of said frequency bands by a predetermined frequency width by periodically varying corresponding group delay characteristics.

11. The sound system of claim 10, wherein said predetermined frequency width represents a single unitary value for every center frequency variation.

12. The sound system of claim 10, wherein said all-pass filter cyclically increments each of said center frequencies by said predetermined frequency width for a predetermined number of cycles.

13. A sound system with a howling-prevention function, for inputting an audio signal issued from a microphone thereto, said system comprising:

an all-pass filter having group delay characteristics which vary with the elapse of time, provided on a line used for the transmission of said audio signal, whereby time-dependent variations of the group delay characteristics of said all-pass filter are made faster as frequencies become high.

14. A sound system according to claim 13, wherein said all-pass filter comprises a secondary IIR type filter.

15. A sound system according to claim 14, wherein said secondary IIR type filter is constructed in the form of arithmetic-operation processing executed by a digital signal processor.

* * * * *